US006478487B1

(12) United States Patent
Jou et al.

(10) Patent No.: US 6,478,487 B1
(45) Date of Patent: Nov. 12, 2002

(54) LINE PRINTER VARIABLE PRINT RIBBON SYSTEM

(75) Inventors: Jeng-Dung Jou, Irvine, CA (US); Y. Grant Chang, Irvine, CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 09/887,415

(22) Filed: Jun. 22, 2001

(51) Int. Cl.[7] ..... B41J 33/04
(52) U.S. Cl. ..... 400/240; 400/197
(58) Field of Search ..... 400/240, 197

(56) References Cited

U.S. PATENT DOCUMENTS

| | | | | | |
|---|---|---|---|---|---|
| 4,480,541 | A | * | 11/1984 | Grummett | 101/93.04 |
| 4,513,661 | A | * | 4/1985 | Melissa et al. | 101/93.04 |
| 4,530,612 | A | * | 7/1985 | Butera et al. | 400/232 |
| 4,653,947 | A | | 3/1987 | Echols | |
| 5,135,803 | A | | 8/1992 | Tanaka et al. | |
| 5,259,875 | A | | 11/1993 | Tanaka et al. | |
| 5,344,242 | A | * | 9/1994 | Farb | 400/124.2 |
| 5,362,556 | A | * | 11/1994 | Shini | 428/321.3 |
| 5,466,073 | A | * | 11/1995 | Rossi et al. | 400/197 |
| 5,570,963 | A | | 11/1996 | Gill | |
| 5,595,446 | A | * | 1/1997 | Barrus et al. | 400/124.13 |
| 5,832,820 | A | * | 11/1998 | Barrus | 101/93.04 |
| 6,017,158 | A | * | 1/2000 | Conlan | 400/197 |

FOREIGN PATENT DOCUMENTS

| | | | | |
|---|---|---|---|---|
| JP | 1-249377 | * | 10/1989 | B41J/31/00 |
| JP | 2-32888 | * | 2/1990 | B41J/31/00 |
| JP | 2-80283 | * | 3/1990 | B41J/35/20 |

* cited by examiner

*Primary Examiner*—Andrew H. Hirshfeld
*Assistant Examiner*—Charles H. Nolan, Jr.
(74) *Attorney, Agent, or Firm*—George F. Bethel

(57) ABSTRACT

An impact printer such as a line printer having a base with a hammerbank mounted on the base driven for reciprocal movement. The hammerbank has a plurality of hammers with printing tips formed on frets in two longitudinally oriented rows defining an upper row and a lower row. A permanent magnet with pole pieces retains the hammers until a coil overcomes the magnetic retention. A print ribbon is impacted by the printing tips of the impact printer such as a line printer against a print media. The print ribbon has a first longitudinal high strike zone of ink of greater print yield with a low strike zone of lesser print yield on either side of the first zone. The print yield can be a factor of ink viscosity, pigment content, fabric content, fabric composition, or dye features.

20 Claims, 4 Drawing Sheets

IMPROVED TEXT WITH INVENTION

TEXT BEFORE INVENTION

LINE PRINTER VARIABLE PRINT RIBBON SYSTEM

BACKGROUND OF THE INVENTION

1. Field of the Invention

The field of this invention is within the impact printer field and in particular, the line printer field directed toward using a line printer having multiple hammers with tips that strike a ribbon that impacts an underlying print media such as paper. The line printers are such where they have a number of hammers on the hammerbank which are held by a permanent magnetic force and then released by electromagnetism. When released, the hammer tips strike a ribbon which impacts the underlying media to be printed upon. During the striking of the ribbon, the ink is depleted from the ribbon in a manner whereby variances of appearance of the printed product can be apparent.

2. Prior Art

The prior art with regard to line printers incorporates various line printers having singular rows of hammers with printing tips in a hammerbank. These rows of hammers in a hammerbank are released from permanent magnetic retention by an electromagnetic coil. The hammer tips when released proceed toward an inked ribbon for impacting against a media to be printed upon.

Recently, a new hammer orientation has been developed wherein a hammerbank having dual hammers incorporates an upper and lower set of hammers. These upper and lower sets of hammers are released so that the ink or print ribbon is impacted by two hammers in an upper and lower or duplex banked mode. This dual print activity by the hammers puts a double load on the capacity of the ink or print ribbon for providing ink. To this extent, the capacity of the ink ribbon if it is consistent through the ribbon causes variances because of variously differently oriented strike zones.

The term banding is a term wherein one of two printed lines will be darker on the right side than on the left. The next line will be darker on the left and lighter on the right.

The two rows of hammers which are on top of each other having an upper and lower set of hammers are spaced approximately one sixth of an inch apart. They simultaneously print adjacent rows, effectively doubling the through put of the printer.

The printing is by a printed dot when the hammer strikes against an inked ribbon leaving a dot on the paper or underlying media. A one inch or wider inked ribbon reciprocates or translates continuously between the hammers and the paper or media at an incline. This incline is to allow for greater ribbon use since the incline causes the ribbon to cross the total number of hammers. The incline helps to eliminate a concentration of the hammers impacting the print ribbon in one particular area such as down the middle.

A heretofore unsolved problem with the dual row arrangement of hammers is that the center area across the ribbon width of the ribbon is generally struck twice or at least more than once during each pass of the ribbon. To the contrary, the outer boundaries are only struck once or less. The result is that after a relatively small number of printed pages a light and dark pattern of printed lines appears.

For instance, one of the two printed lines such as that printed by the upper row of hammers will be darker on the right side than on the left. The next line of print as printed by the lower row, will be darker on the left and lighter on the right side. This particular phenomena or effect is known as banding.

A second lesser disadvantageous effect occurs which is addressed by this invention. This second effect is that the printing density varies from darker appearances at the edges of the page, to lighter appearance toward the middle of the page. This is due to the high ink concentration of the unused edges of the ribbon. These boundaries are necessary to insure that in all cases the end hammers always strike inked ribbon. Since the ink in these boundary areas does not get removed from the ribbon as the result of hammer strikes it tends to defuse into the adjacent area. This particular characteristic is referred to as a diffusion effect. The diffusion effect causes the print at the edges as previously stated on the paper to be darker than the center. This is independent of the banding effect.

The diffusion effect can be worse on the left side of the paper than on the right side. This is due to the effect of gravity on the ink in the ribbon. The reason is that the left side of the printed page derives its ink from the lower left portion of the inclined ribbon.

The invention hereof tends to overcome the foregoing deficiencies of the prior art by providing for an ink or print ribbon which has a variable characteristic. When being struck, it compensates for the fact in certain portions the ribbon is being struck twice as much or more than the other portions. These particular portions are generally in the central area where the larger amount of strikes take place.

SUMMARY OF THE INVENTION

In summation, the invention reduces banding, diffusion, and gravity effects by locating inks with different printing yields provided by varying concentrations, pigment contents, or viscosity on different portions of the ribbon such as in the longitudinal central portion and the edge portions in such a manner as having a greater printing yield in the middle and a lesser printing yield on the edge portions.

More specifically, the highest ink concentration or print yield is located in the middle of the ribbon or the longitudinal center. This generally corresponds with a double or more than one strike zone. Proportionally ink having a lesser yield is located at the upper and lower boundary areas which are used less. These longitudinal boundary areas are such where the lower ink yield provides for the lesser hammer strikes which can be in a range of one half the hammer strikes as received in the longitudinal center of the ribbon. In this manner, the ribbon will be located with appropriate ink yields on different portions based upon consumption, thereby reducing the banding, diffusion, and gravity effects.

It has been found that this is extremely helpful with regard to impact printers and particularly to double row line printers where hammers are queued or banked above each other. The net result is an. improved printout which can be seen hereinafter in the specification hereof.

DESCRIPTION OF THE PREFERRED EMBODIMENTS

Figure 1:
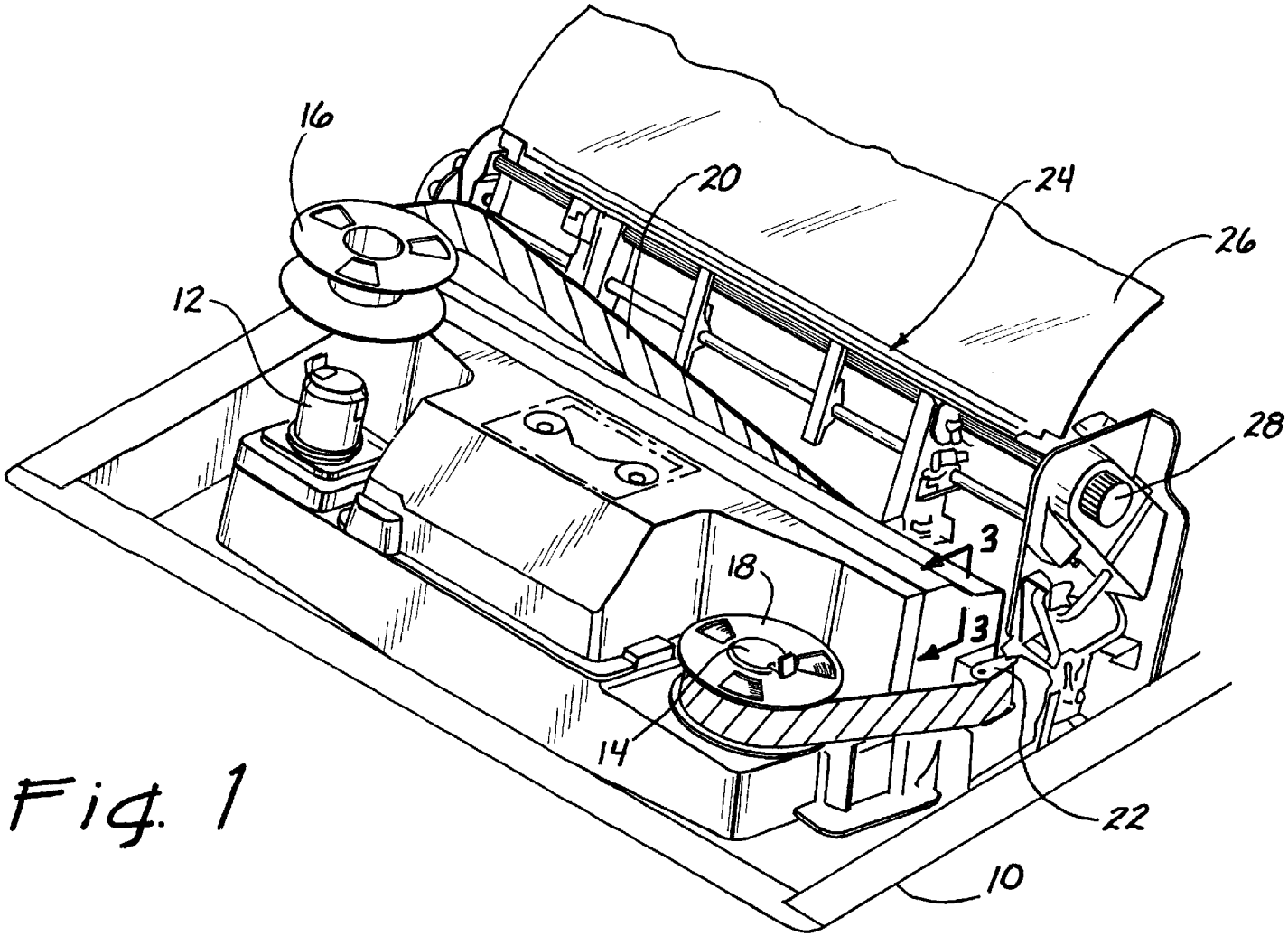
FIG. 1 shows a perspective view of a fragmented portion of a line printer having paper or other print media passing through the printer.

FIG. 1 shows a perspective view of a line printer employing this invention. In particular, the line printer incorporates a base 10 which can be part of a stand or part of a mobile or desktop unit. The printer has a pair of hubs 12 and 14 which respectively receive spools 16 and 18 of print ribbon. The spools 16 and 18 that receive print ribbon have the print ribbon wound therearound in a consistent manner to be driven in a reciprocating, transitional, or traversing manner back and forth across the hammerbank. The ribbon moves from one spool 16 to the other spool 18 in a winding and unwinding manner so that it traverses backwardly and forwardly for the substantial length of the ribbon in front of the hammerbank. In this particular case, the spool 16 is being shown emplaced upon the hub 12.

The ribbon is shown specifically as a ribbon 20 being fed between the two respective spools 16 and 18. The ribbon 20 is fed around a ribbon guide 22 on either side. The ribbon guide 22 also has a sensor to show when the ribbon has passed a certain point and is to be reversed.

The printer incorporates a paper feeder generally shown as paper feeder 24 which feeds paper 26 across the throat of the printer for printing by the hammerbank hammer tips impacting the ribbon 20. A knurled knob 28 is provided in order to hand feed the paper 26 across the face of the print head or hammerbank. Tractors are provided which feed the paper at the edges which have been provided with punched openings to be fed by the protuberances of the tractor moving the paper 26.

Figure 2:
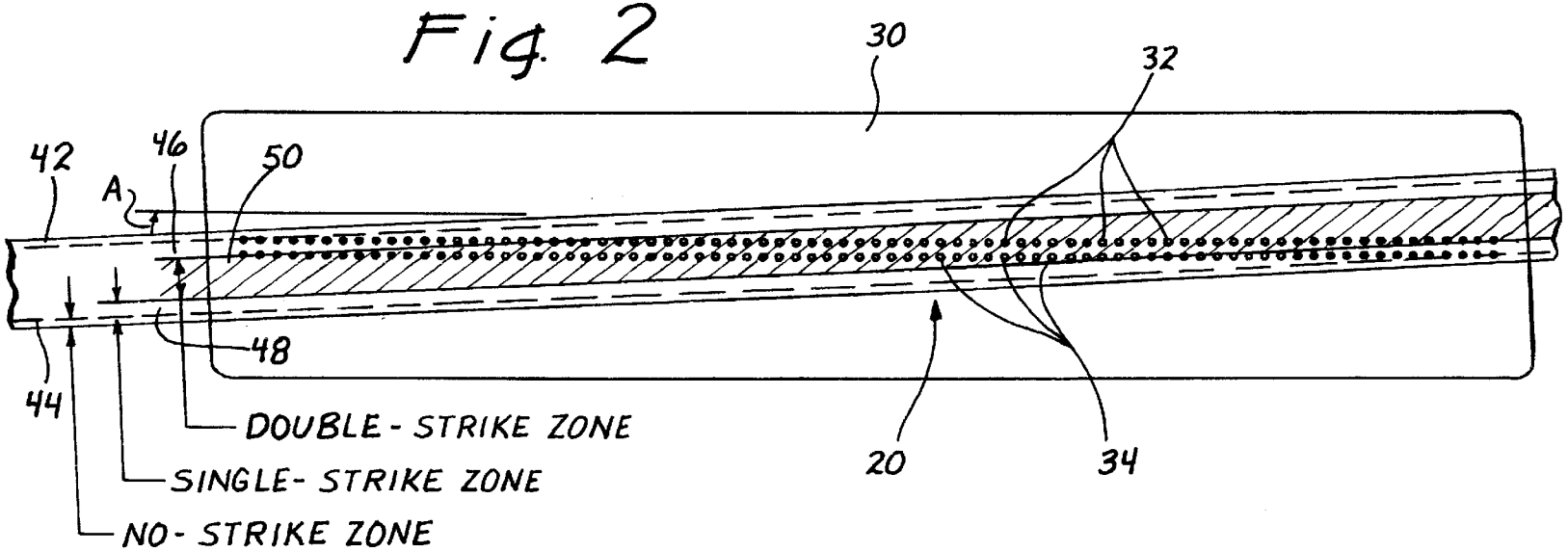
FIG. 2 is a front elevation view showing the print ribbon of this invention passing across the double bank of print hammers.

The print ribbon 20 is such where it passes over a ribbon or print mask shown in FIG. 2. The ribbon or print mask shown in FIG. 2 is shown as ribbon mask 30. The ribbon mask 30 has a plurality of openings 32 on an upper portion and 34 on a lower portion through which hammer tips extend. The ribbon 20 is angled or inclined with respect to the alignment or longitudinal relationship of the line of print hammers. The angle of inclination which is shown as angle A is approximately 2.70° from the longitudinal axis of the line of print hammers. The angle can vary depending upon the number of hammers and spacing.

The ribbon 20 when traveling across the print hammers traverses multiple segments of the ribbon backwardly and forwardly over hammer tips. If the ribbon were not angled, it would create a situation wherein all the striking hammer tips striking through the ribbon mask openings 32 and 34 would strike in one particular width area. For instance, it might be in the center or on the edges depending on where the ribbon 20 were oriented.

The strike zone of a ribbon when angled across a great number of hammerbank print tips extending through the print mask 30 provides for an angular striking across the width of the ribbon as it traverses backwardly and forwardly. This accomplishes a greater striking of the ribbon 20 except in a particular outer no strike zone.

Looking more particularly again at FIG. 2, it can be seen that this no strike zone is on the peripheral edges namely no strike zone 42 on the upper no strike zone and no strike zone on the lower no strike zone 44. These longitudinal no strike zones 42 and 44 are emplaced in order to avoid the hammers impinging against the areas that are extremely marginal.

A low or single strike zone 46 in the upper portion and 48 in the lower portion allows for a low or single strike of the hammer tips along the longitudinal length inasmuch as the ribbon does not traverse and incur that area of the double hammers when it is placed at the angle A.

Finally, the high or double or more than one strike zone 50 is shown which is approximately twice the width of each of the low or single strike zones 46 and 48. This accommodates the double hammer tips throughout the entire zone 50.

Figure 3:
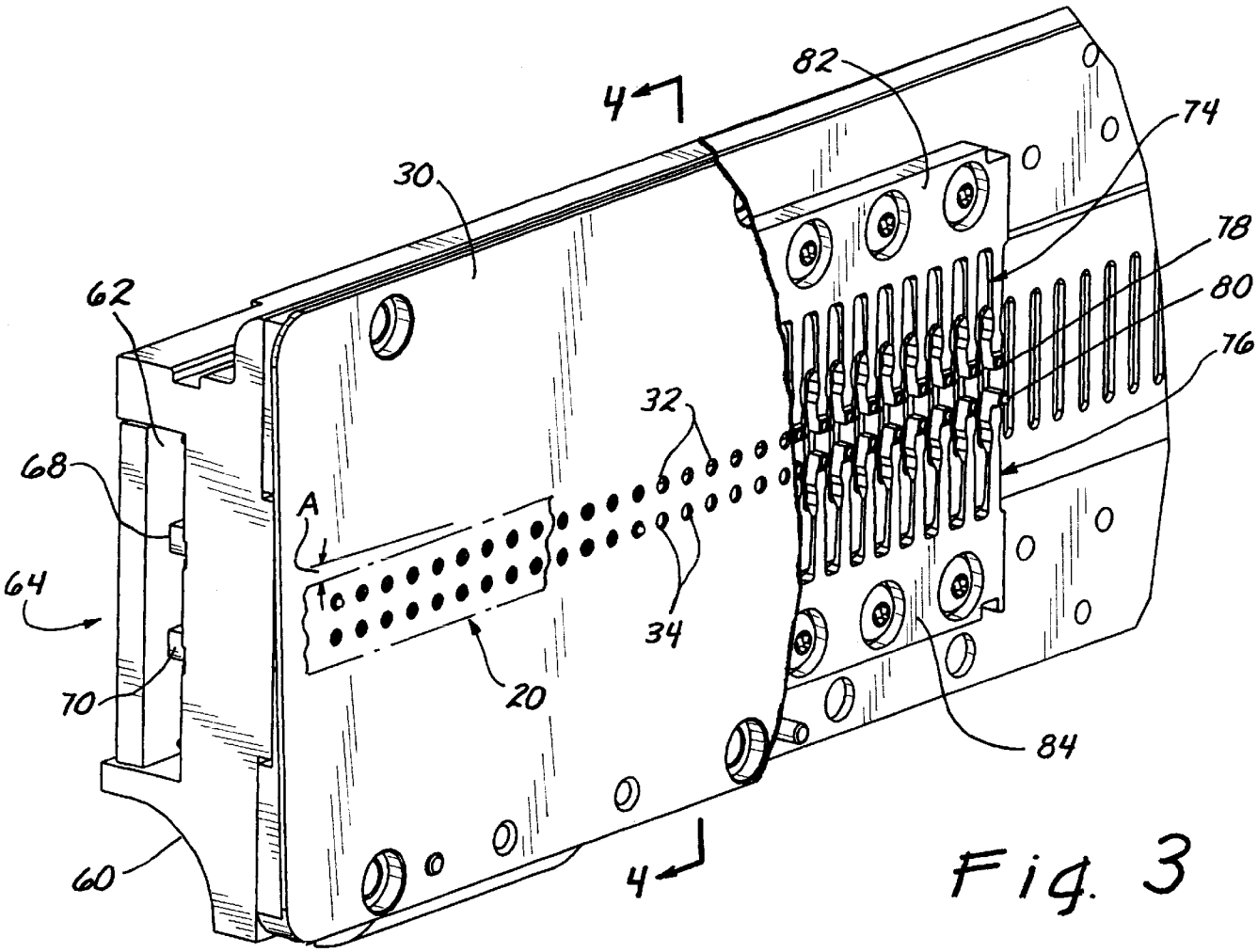
FIG. 3 is a perspective fragmented view of the hammers and print mask of this invention along lines 3—3 of FIG. 1.

In order to understand the characteristics of the print mechanism, it can be seen that the ribbon mask 30 is shown in FIG. 3 connected to a hammerbank 60. The hammerbank 60 is generally made of a solid material and can be milled, cast, or formed in any particular manner. The hammerbank has a slot 62 that receives a circuit board 64. The circuit board 64 mounts drivers and controls as well as logic to drive the hammers which will be detailed hereinafter.

The hammerbank 60 with the hammers connected thereto incorporate permanent magnets 68 and 70. The permanent magnets 68 and 70 draw in the hammers to their magnetic pole piece ends. They are then released through a change of magnetic retention force through a series of coils in relationship to each hammer which will be seen in greater detail in FIG. 4.

Again, looking more specifically at FIG. 3 it can be seen that hammers in the upper section namely hammers 74 are shown in the upper bank while hammers 76 are shown in the lower bank. These respective hammers 74 and 76 have tips or pins respectively 78 an 80 that pass through the openings 32 in the upper portion and 34 in the lower portion of the ribbon mask 30.

The hammers 74 and 76 are formed on frets 82 and 84 respectively on the upper and lower hammerbanks. These frets 82 and 84 are such wherein they are milled or formed. The hammers 74 and 76 thereafter are cut thereon or formed such as by an electro discharge cutting or milling operation.

FIG. 3 shows the ribbon 20 superimposed in a fragmented form in dotted configuration over the openings 32 and 34 of the print ribbon mask 30. The print ribbon mask is seen as ribbon mask 30 in FIG. 4 with the openings 32 and 34.

Figure 4:
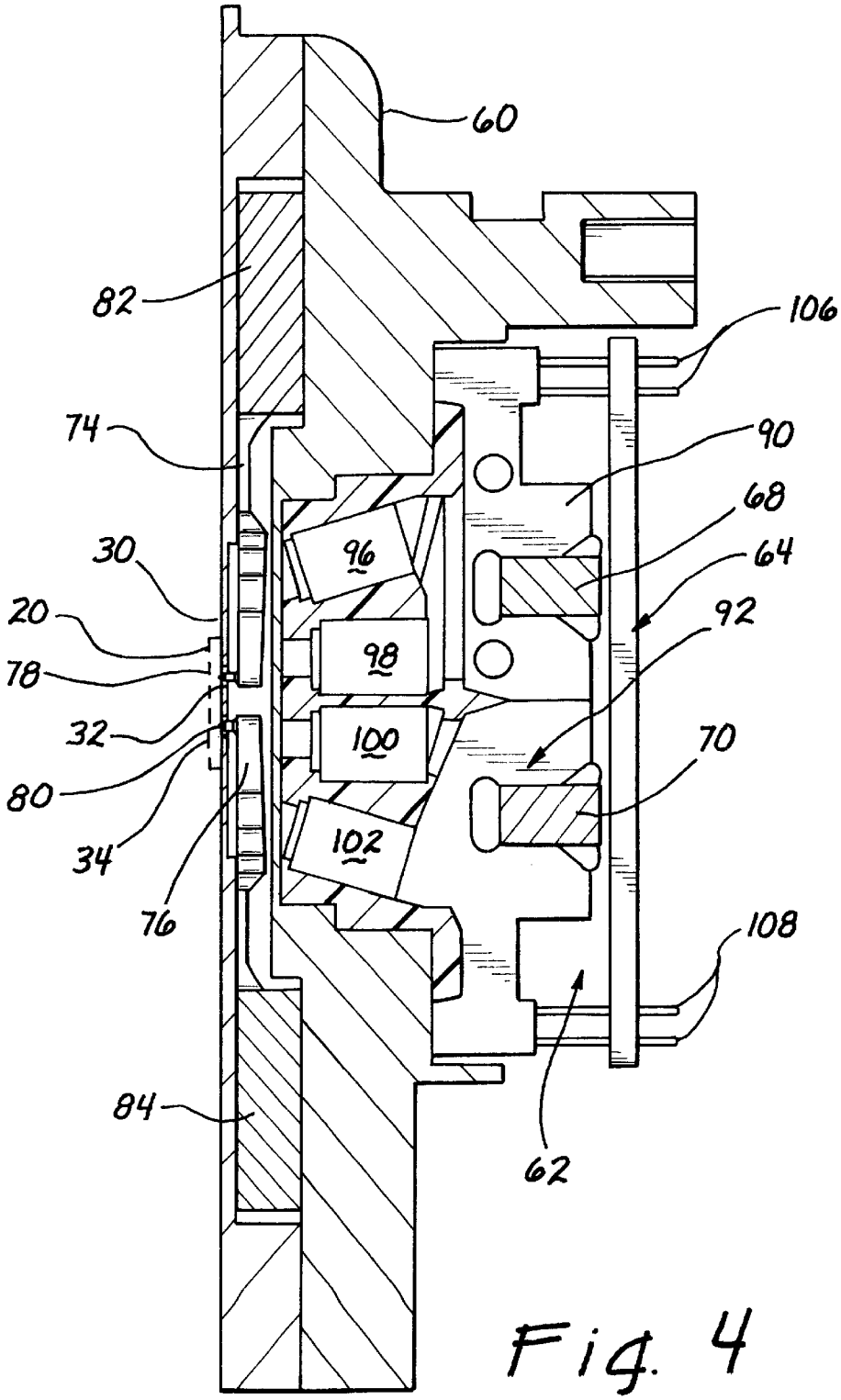
FIG. 4 is a sectional view along lines 4—4 of FIG. 3.

Looking more particularly at FIG. 4 it can be seen that the hammerbank body 60 has been shown with the permanent magnets 68 and 70 in respective slots in the upper and lower hammerbank portions. The permanent magnets 68 and 70 are mounted and magnetically connected to pole pieces 90 and 92. These form a magnetic loop through the ends of the pole pieces.

The pole pieces 90 and 92 are wrapped with pairs of coils. Pole piece 90 has coils 96 and 98 wrapped therearound while pole piece 92 has coils 100 and 102 wrapped around the ends thereof. The coils 96 through 102 are connected to electrical connectors or terminals. The upper set of coils 96 and 98 are specifically connected to connectors 106. The coils 100 and 102 have the coils connected to a second set of connectors 108. These connectors 106 and 108 are connected to the circuit board 64. Circuit board 64 has transistor drivers thereon which provide power through a firing sequence of the coils 96 through 102 which causes the hammers of the hammerbank to be released from their magnetic retention. The coils 96 through 102 create an electromagnetic field that overcomes the permanent magnetism of the magnets 68 and 70.

When looking at the hammers, it can be seen that the upper hammers 74 have a pin or tip 78 extending therefrom. The lower hammer 76 has a pin or tip 80 extending therefrom. These pins pass respectively through the openings 32 and 34 of the ribbon mask 30. The hammers are mounted with their frets 82 and 84 as shown in the general configuration provided in both FIGS. 3 and 4.

When the permanent magnetism of magnets 68 and 70 is overcome by the coils 96 through 102 causing a release thereof, the pins 78 and 80 fire through the openings 32 and 34 of the ribbon mask and impinge against the ribbon 20 passing thereover. When striking against the ribbon 20 passing thereover, they strike against a media such as paper 26 passing through the printer and provide for a dot thereon.

The ribbon 20 has been shown superimposed in dotted form with the respective portions of this invention that will be explicitly detailed further hereinafter.

Again, looking at the ribbon 20 as shown in FIG. 2 it can be seen that there is a double, high, increased, or multiple strike zone 50. Low, decreased or single strike zones 46 and 48 bound each side of zone 50. De-minimis or no strike zones 42 and 44 are at the peripheral edges.

The objective of the invention is to minimize banding, diffusion, and gravity effects by locating inks with different print yields in the respective high or double strike zone 50 and low or single strike zones 46 and 48. The highest ink load or high print yield ink is located in the middle section of the ribbon namely the high or double strike zone 50.

Proportionally, less ink and lower print yield is required in the low or single strike zones 46 and 48. These are the respective upper single striking zone and lower single striking zone as well as the de-minimis or no strike zones 42 and 44. This causes the ribbon to be located with appropriate inks for different printing yields on different portions based on consumption and decreased yield. This minimizes the banding, diffusion, and gravity effects.

The areas of the high or double strike zone 50 and the low or single strike zones 46 and 48 have been delineated generally as the high or double strike zone 50 receiving twice as many impacts as the low or single strike zone. However, it should be understood that when the hammers are not firing because of the orientation of the dots, that this can vary from outside of a two to one relationship. The strike zone relationships can be wherein the strikes take place at a lesser or higher ratio than two to one depending upon the type of printing and the specific alpha numeric or bar code or other orientation that is to be printed. In effect, the duty cycle of the hammers impinging the ribbon could vary with respect to the two zones 46, 48, and 50 and not be confined strictly to the low or single and high or double characterizations. However, as a general rule the average of strikes between the multiple, high, or double zone 50 and the low or single zones 46 and 48 will be approximately on a two to one ratio if the printing between the zones is within the realm of generally analogous characters or print forms.

When referring to print yield, the reference is to the number of strikes, or impacts by the tips 78 or 80 against the print ribbon 20 and the attendant or related print output or printing life. For example a ribbon having twice the print yield for the high, double or multiple strike zone 50 would be able to print approximately twice as much as the low or single strike zones 46 and 48 without significant deterioration of print quality. In effect, the impacts on the ribbon 20 can be approximately or substantially twice as great in high or double strike zone 50 with a print yield substantially or approximately twice as great as the lesser print yield of the low or single strike zones 46 or 48. The print yield is calculated to be in proportion to the number of impacts or strikes so that the print remains substantially uniform.

The ink compositions of the present invention are generally the same compositions and components used in conventional printer inks. These generally can include a vehicle or carrier and at least one coloring agent. Other materials are often included such as for example, a dispersing agent, a viscosity adjusting agent, a humectant, an emulsifying agent or surfactant, and a drying-preventive agent, an infrared absorptive dye and/or an antifungal agent.

With respect to the coloring materials, these can include various kinds of organic or inorganic pigments for example, those of the azo series, phthalocyanine series, quinacridone series, anthraquinone series, dioxazine series, indigo series, benzidine series, thioindigo series, perinone series, perylene series, isoindolenone series, titanium oxide, cadmium series, iron oxide series, carbon black, and the like.

Dyes characterized by satisfactory permanence in spite of exposure to light, air and normal handling are referred to as "fast" dyes; others are "fugitive." Most dyes are synthesized from the aromatic hydrocarbons (coal-tar dyes) and related materials. Dyes are classified according to chemical composition and also according to the way in which they behave during application. The most important chemical types are the azo, anthraquinone, sulfur, indigoid and stilbene dyes. The chemical classes of coloring matters and their arrangement according to chemical structures have been designated numerically according to the "Colour Index" (1957 revision) as follows:

| Chemical Class | Colour Index |
|---|---|
| Nitroso | No.10000–10299 |
| Nitro | 10300–10999 |
| Monazo | 11000–19999 |
| Disazo | 20000–29999 |
| Trisazo | 30000–34999 |
| Polyazo | 35000–36999 |
| Azoic | 37000–37999 |
| Stilbene | 40000–40999 |
| Diphenylmethane | 41000–41999 |
| Triarylmethane | 42000–44999 |
| Xanthene | 45000–45999 |
| Acridine | 46000–46999 |
| Quinoline | 47000–47999 |
| Methine | 48000–48999 |
| Thiazole | 49000–49399 |
| Indamine | 49400–49699 |
| Indophenol | 49700–49999 |
| Azine | 50000–50999 |
| Oxazine | 51000–51999 |
| Thiazine | 52000–52999 |
| Sulfur | 53000–54999 |
| Lactone | 55000–55999 |
| Aminoketone | 56000–56999 |
| Hydroxyketone | 57000–57999 |
| Anthraquinone | 58000–72999 |
| Indigoid | 73000–73999 |
| Natural | 75000–75999 |

The vehicle or carrier can include, for example, organic acids such as aliphatic carboxylic acids such as lauric acid, myristic acid, palmitic acid, stearic acid, isostearic acid, oleic acid, adipic acid, citric acid and ascorbic acid; aromatic carboxylic acids such as benzoic acid, salicylic acid, phthalic acid, isophthalic acid, terephthalic acid, naphthoic acid, gallic acid and tannic acid; and sulfonic acids such as dodecyl sulfonic acid and alkylbenzenesulfonic acid.

Various oily substances can also be used as the dissolution medium for the dye or the dispersion medium for pigment. Examples of the oily substances include among others: vegetable oils such as rapeseed oil, castor oil and soybean oil; animal oils such as beef foot oil; higher fatty acids such as isostearic acid and oleic acid and mixtures thereof.

Typical examples of the surfactants are sorbitan monoleate, sorbitan trioleate, polyoxyethylene sorbitan monooleate, and polyoxyethylene monolaurate.

Examples of humectants include among others alcoholamines (triethanolamine and similar alcoholamines), fold 14 alkylamines (triethylamine and similar alkylamines) and aliphatic lower alcohols (ethanol, propanol, hexanol and similar alcohols); examples of emulsifying agents include among others aromatic polyglycol ether, alkyl aryl polyglycol ether and sorbitan monooleate; and examples of drying-preventive agents include among others alkyl naphthalene sulfonate and alkyl aryl sulfonate.

The viscosity can be adjusted in various ways as each ingredient contributes to the final viscosity. In addition to the vehicle or carrier, other ingredients can be added which can further adjust the viscosity.

Examples of viscosity-adjusting agents include among others mineral oils such as motor oil; and synthetic oils such as olefin-polymerized oil (e.g. ethylene hydrocarbon oil, butylene hydrocarbon oil, and the like), diester oils (e.g. dioctyl phthalate, dioctyl sebacate, di(1-ethylpropyl) sebacate, dioctyl azelate, dioctyl adipate, and the like), and silicone oils (e.g. linear dimethyl polysiloxane having a low viscosity, and the like). Mixtures of two or more kinds can be used.

Examples of the pigment-dispersing agent include among others sorbitan fatty acid esters, polyoxyethylene sorbitan fatty acid esters, polyoxyethylene sorbitan alkyl ethers, glycerin fatty acid esters, propylene glycol fatty acid esters, polyethylene glycol fatty acid esters, polyoxyethylene alkyl ethers, hardened castor oil derivatives and polyoxyethylene castor oils. One or a mixture can be used.

The ribbon is commonly formed of generally woven cloths including for example, fibers such as nylon, polyester, cotton and silk. The thickness of the ribbon substrate can vary but is commonly from about from about 80 to about 140 .mu.m. Generally, the ink composition is contained in an amount of about 8 to about 21 g/m.sup.2 into the substrate.

The inks can be made in a conventional manner by thoroughly mixing together the ingredients in any convenient manner known to those skilled in the art. The resulting mixture can be adjusted for the desired viscosity as described herein and applied to the ribbon to the desired thickness in any convenient manner.

Thus, the basic characteristics of ink and their ingredients or portions of the compounded ink relate firstly to a vehicle or carrier which can be a fatty acid such as oleic acid or a similar vehicle. Secondly, the ink can include pigments which can be solid such as carbon black or other coloring materials which will affect the infrared reading characteristics of the printed material. The infrared characteristics are important with regard to certain bar code scanners. Thirdly, supplementary additives can be a number of things but each has its specific purpose. For example, these supplementary additives in the way of dyes can be such as induline, azine, methyl violet, or nigrosine, or other dyes which can adjust viscosity and flow properties.

Differences in ink properties and attendant print yields can be a result of variations in the foregoing three basic ingredient groups. Although, other ingredients and compounds can be utilized, the foregoing constitutes the general nature of the materials that result in variations in the print ribbon characteristics and corresponding print yield.

The function of the vehicle or carrier is to act as a carrier for the pigment and as a binder to affix the pigment to the printed surface of the paper or other media. The nature of the vehicle or carrier is such where its viscosity determines the flow characteristics of the ink and attendant print yield. Viscosity fundamentally is the liquid's resistance to flow in the form of the carrier, the higher viscosity, the less resistance to flow. Ink ribbons of high viscosity ink have a longer life or higher print yield than lower viscosity ink because the high viscosity ink restrains the amount of ink transferring to the media upon impact.

The pigments are usually finely divided solid materials that give inks color and opacity or transparency along with other important qualities. Such pigments can be in the form of carbon black, lamp black, or other colored particulate materials. High pigment content has a greater tendency to place the ink on the paper which offsets or lowers the print yield. It should also be understood that the pigments generally do not chemically bond to the carrier but rather form a relationship on the basis of van der Waal's forces. In effect the higher the ratio of pigment in the ink, the lesser the life or print yield.

The ribbon 20 of this invention is composed of three inked or relative print yield portions. This can be seen in FIG. 2. The outer longitudinal portions or boundaries have a comparatively low ink life or print yield namely those portions which are the low or single strike zones 46 and 48 and the no strike zones 42 and 44. These specifically consist of ink having a low concentration, high pigment, or low viscosity which has a relatively low character, or print yield. It has been found in the art that a high pigment content creates a situation wherein the ribbon does not last as long or has a lesser print yield because of the pigment itself being displaced from the carrier.

The longitudinal middle portion of the ribbon 20 namely the high or double strike zone So is composed of ink with higher character or print yield.

By carefully formulating ink concentration, pigment content, or ink viscosity, the ribbon is able to maintain appropriate ink loads or yields on the high or double strike zone 50 and the low or single strike zones 46 and 48. The result is to create a print yield or life approximately twice as great in the high or double strike zone 50 as that of the low or single strike zones 46 and 48.

As to the formulations, concentrations, viscosities, and general characteristic of the inks, they can vary within the realm of variable print yields. The main criteria is that the highest ink load or print yield is to be located where the highest concentration of impacts occur.

Proportionally less ink or characteristic print yield is located in the outer portions of the ribbon namely those portions 46 and 48. These respective zones 46 and 48 which are struck generally only singularly, do not require as much ink or print yield. Accordingly, this eliminates the darkness and lightness between the respective low or single strike zones 46 and 48 and the high or double strike zone 50. As can be appreciated, other configurations of strike zones would require different concentrations of ink or print yields. For instance, if the ink striking zones were to be differently oriented as to perhaps multiple banks of hammers in the outer zone as opposed to the inner zones due to canting or stepped hammer locations in side-by-side relationship, then the orientation of ink concentration or print yield would then have to change. In this manner, the ribbon will be located with appropriate inks or ink yields on different portions based on consumption thereby minimizing the banding, diffusion, and the gravity effects.

The three basic ingredients or classifications of ink are the carrier or vehicle (oleic acid), the pigments (solids), and supplementary additives. These generally are such wherein the carrier can control the viscosity, the pigment can control the amount of ink being transferred from ribbon to paper and such additives as nigrosine, methyl violet, or other dyes can also control part of the nature of the ink. The foregoing in concert control the print yield of the ink.

Viscosity is a very important facet with regard to the flow of the ink. To this extent, it is such where it has greater variability and concentration elements with regard to the overall nature of it to provide for more discrete control and attendant print yield. Pigment in certain cases, because of the impacts causing the pigment to be driven from the carrier or the ribbon, creates a situation wherein the pigment when in greater concentration actually lessens the life or print yield of the ribbon. This is because the pigments are finely divided solid materials that give the inks the color and opacity or transparency depending upon the particular concentration. High pigment content has a greater tendency to displace the ink to the paper which offsets the character or print yield.

It has been found that with regard to viscosity the respective ink characteristics between the low or single strike zones 46 and 48 and the high or double strike zone 50 are such wherein the range can be 2700 centipoises (CPS) for the low or single strike zones 46 and 48 and 3400 CPS for the high or double strike zone 50. Viscosities can also range from 500 CPS for the low strike or single strike zones 46 and 48 up to 4200 CPS for the high or double strike zone 50.

As to ink concentration, with regard to overall concentration of ink on the ribbon, the low strike or single strike zones 46 and 48 can range upwardly from approximately 8%. The high strike or double strike zone 50 range can be as high as 28%. By concentration of ink, it is meant the overall concentration of ink on a given ribbon when compared to the ribbon without ink. This is the percentage of weight of the ink on the ribbon. In effect, concentration is the percentage of ink on the ribbon when compared to the uninked ribbon.

The pigment content which can be formulated from lamp black or carbon black can be upwards from 0% for the high or double strike zone 50. The low or single strike zones 46 and 48 can have pigment content up to 40%. This is because of the fact that as the concentration of pigment is increased, it actually decreases the overall life or print yield of the low or single strike zones 46 and 48. This is due to the fact as previously noted that it becomes displaced more readily. The relative characteristics of the ink ribbon are modified proportionally between the high or double strike zone 50 and the low or single strike zones 46 and 48.

Aside from pigment content, viscosity, and dye yield or content, other factors can affect print yield. For instance, the total percentage of ink concentration or weight of ink on the ribbon changes the print yield as previously discussed.

Fabric content or density of fabric also is a factor. For instance, a more dense fabric will retain more ink and provide a greater print yield. Thus for the high or double strike zone 50, the ribbon can be provided with a band or median longitudinal segment of greater fabric density. In such a case the relative density of the low or single strike zones 46 and 48 can be of a lesser fabric density.

The fabric material can also be varied. For instance, the lower yield zones 46 and 48 can be made from strips having less ink retention or absorbency. Thus a natural fabric or blend can be used for higher print yield in zone 50 and a less absorbent synthetic material for lower print yields in zones 46 and 48.

The one characteristic that should be maintained is that the single or lesser strike zones 46 and 48 will have a lesser life or print yield than the double or concentrated high or double strike zone 50. These print yields can be derived so that the ink when displaced from the two respective zones will diminish at the same rate. In effect, the net result from the foregoing print yields in each zone is to have the low or single strike zones 46 and 48 depleted as close to the same rate as the low or single or high or double strike zone 50. Thus, as the ink is depleted at the same rate the banding appearance of the print is diminished so that variations in appearance are diminished. This provides for a consistently appearing print as to overall ink displaced and print quality on the paper, or other media 26.

Figure 5:
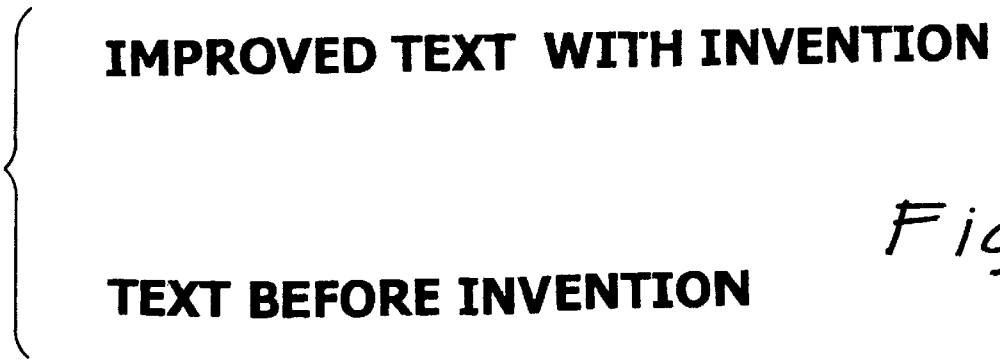
FIG. 5 shows a view of the improved text and printing when using this invention.

The result when reviewing the drawings can be dramatically exemplified in the showing of FIG. 5. The printed text with the invention can be seen in FIG. 5 as being the "improved text with invention". The text without the invention as known in the prior art can be seen as the "text before invention". These two respective characteristics of appearance are dramatized in FIG. 5 to show the effect of the invention and the improvement over the prior art.

While the invention has been described particularly with respect to line printers, the invention is not limited thereto and is intended to be applied to any impact printer for increased print yield.

Various modifications of the invention are contemplated which can be resorted to by those skilled in the art without departing from the spirit and scope of the invention as defined by the following claims.

What is claimed is:

1. A line printer comprising:

a hammerbank with a plurality of hammers having printing tips and permanent magnets for retaining them from release;

electrical coils in association with said hammers for releasing said hammers by overcoming the permanent magnetism provided by the permanent magnets;

a print media support and drive for moving print media across said hammers;

a print ribbon drive for moving a print ribbon across said hammers between said print media and said hammers;

an ink ribbon having a first high strike zone longitudinally extending on said print ribbon bounded by a low strike zone longitudinally extending on either side of said first zone, said first high strike zone having ink with a higher viscosity than said low strike zone; and, said first high strike zone has a greater print yield than said low strike zones.

2. The line printer as claimed in claim 1 further comprising:

said print ribbon is angled with respect to the longitudinal orientation of said hammers.

3. The line printer as claimed in claim 1 further comprising:

said hammers are formed on said hammerbank as two rows of hammers.

4. The line printer as claimed in claim 3 wherein:

said two rows of hammers are formed as an upper and lower series of hammers.

5. The line printer as claimed in claim 1 further comprising:

said first zone having a viscosity of 200 centipoise exceeding that of the zone on either side.

6. The line printer as claimed in claim 1 further comprising:

said low strike ink zones on the boundary of said first high strike zone having a greater amount of pigment than said first ink zone.

7. An impact printer comprising:

a plurality of printer tips;

a driver for driving said printer tips for impacting a ribbon in relationship to a media to be printed upon; and, a print ribbon oriented for impact by said printer tips having a first high strike ink zone and a low strike ink zone having a lesser print yield than said first zone, said first high strike ink zone having a pigment concentration less than the low strike ink zone.

8. The impact printer as claimed in claim 7 further comprising:

said print ribbon is angularly offset from the orientation of said printer tips; and, said first high strike ink zone has an ink viscosity greater than the low strike ink zone.

9. The impact printer as claimed in claim 8 wherein:

said first high strike ink zone has a viscosity exceeding said low strike ink zone by more than 200 centipoises.

10. A line printer comprising:

a base;

a hammerbank mounted on said base for reciprocal movement;

a drive for reciprocally moving said hammerbank;

a plurality of hammers having printing tips, mounted on said hammerbank in two longitudinally oriented rows defining an upper row and a lower row;

a permanent magnet for retaining said hammers magnetically with pole pieces creating a magnetic circuit to retain said hammers;

a coil mounted with respect to each pole piece for overcoming said magnetic retention;

an electrical drive for driving each of said coils;

a print ribbon drive for moving a print ribbon across said hammers on said hammerbank; and, a print ribbon driven by said print ribbon drive wherein said print ribbon has a first longitudinal high strike zone of ink having a given print yield extending along said print ribbon and a low strike zone of lesser print yield on either side of said first zone, the ink of said first high strike zone having a lesser percentage of pigment than the ink of said low strike zone on either side thereof.

11. The line printer as claimed in claim 10 further comprising:

said first high strike ink zone having a print yield greater than said low strike zones on either side is formed with an ink concentration for receiving greater numbers of print tip impacts than said low strike zones on either side.

12. The line printer as claimed in claim 10 further comprising:

said print ribbon is oriented across said print hammers at an angle to the longitudinal orientation of said print hammers.

13. The line printer as claimed in claim 10 further comprising:

the ink of said first high strike ink zone having a viscosity of 200 to 1500 centipoises greater than said low strike ink in the zones on either side of said first zone.

14. The line printer as claimed in claim 10 further comprising:

the ink of said first high strike ink zone having a greater viscosity than the ink of said low strike zones on either side of said first zone.

15. A method for printing with a line printer comprising:

providing a hammerbank of hammers with printing tips longitudinally aligned as an upper bank of hammers and a lower bank of hammers;

retaining said hammers by a permanent magnet;

releasing said hammers trout said permanent magnetism by an electrical coil in proximity to the flux created by said permanent magnet;

passing a media to be printed upon by tips on said hammers; and, impinging said hammer tips against a ribbon having a first high strike ink zone of a greater print yield proximate a low strike ink zone on either side of said first zone having a lesser print yield, wherein the ink viscosity of said first high strike zone is greater than the ink viscosity of said low strike zones on either side by at least 200 centipoise.

16. The method as claimed in claim 15 further comprising:

impinging said first high strike ink zone by said printing tips at a greater rate than either of said low strike ink zones bounding said first ink zone.

17. The method as claimed in claim 15 further comprising:

moving said ribbon at an angle to the longitudinal orientation of said hammers.

18. A ribbon for an impact printer characterized by increased print yield wherein said ribbon has at least one low strike zone and at least one high strike zone longitudinally extending along the length of said ribbon in lateral relationship to each other comprising:

providing ink of high viscosity in said high strike zone;

providing ink of low viscosity in said low strike zone;

the difference in viscosity between said ink of said high viscosity and of said low viscosity is at least 200 CPS;

said viscosity of said ink in said low strike zones has a viscosity of 1400 to 2900 CPS; and, said viscosity of said ink in said high strike zone has a viscosity of 1600 to 3400 CPS.

19. A line printer comprising:

a base;

a hammerbank mounted on said base for reciprocal movement;

a drive for reciprocally moving said hammerbank;

a plurality of hammers having printing tips, mounted on said hammerbank;

a permanent magnet for retaining said hammers magnetically with pole pieces for creating a magnetic circuit to retain said hammers;

a coil mounted with respect to each pole piece for overcoming said magnetic retention;

an electrical drive for driving each of said coils;

a print ribbon drive for moving a print ribbon across said hammers on said hammerbank; and, a print ribbon driven by said print ribbon drive having a first longitudinal high strike zone of ink having a given print yield extending along said print ribbon and a low strike zone of lesser print yield on either side of said first zone, the ink of said first high strike ink zone having a viscosity of 200 to 1500 centipoises greater than the ink of said low strike zones.

20. A line printer comprising:

a base;

a hammerbank mounted on said base for reciprocal movement;

a drive for reciprocally moving said hammerbank;

a plurality of hammers having printing tips, and formed on frets mounted on said hammerbank;

a permanent magnet for retaining said hammers magnetically with pole pieces for creating a magnetic circuit to retain said hammers;

a coil mounted with respect to each pole piece for overcoming said magnetic retention;

an electrical drive for driving each of said coils;

a print ribbon drive for moving a print ribbon across said hammers on said hammerbank; and, a print ribbon driven by said print ribbon drive having a first longitudinal high strike zone of ink having a given print yield extending along said print ribbon and a low strike zone of lesser print yield on either side of said first zone, the ink of said high strike zone having a greater viscosity than the ink of said low strike zones.

* * * * *